US006056202A

United States Patent [19]

Fujimoto et al.

[11] Patent Number: 6,056,202

[45] Date of Patent: May 2, 2000

[54] EXPANSION VALVE

[75] Inventors: Mitsuya Fujimoto; Kazuhiko Watanabe; Masamichi Yano, all of Tokyo, Japan

[73] Assignee: Fujikoki Corporation, Tokyo, Japan

[21] Appl. No.: 08/915,933

[22] Filed: Aug. 21, 1997

[30] Foreign Application Priority Data

Sep. 12, 1996 [JP] Japan ..... 8-242148

[51] Int. Cl.[7] ..... F25B 41/04

[52] U.S. Cl. ..... 236/92 B; 62/225

[58] Field of Search ..... 62/225; 236/92 B

[56] References Cited

U.S. PATENT DOCUMENTS

| | | | |
|---|---|---|---|
| 3,537,645 | 11/1970 | Treder | 62/92 B |
| 3,667,247 | 6/1972 | Proctor | 62/217 |
| 4,468,054 | 8/1984 | Orth | 285/137 R |
| 4,819,443 | 4/1989 | Watanabe et al. | 62/225 |
| 4,979,372 | 12/1990 | Tanaka | 62/225 |
| 5,044,170 | 9/1991 | Tanaka | 62/225 |
| 5,060,485 | 10/1991 | Watanabe et al. | 62/225 |
| 5,127,237 | 7/1992 | Sendo et al. | 62/225 |
| 5,228,619 | 7/1993 | Yano et al. | 236/92 B |
| 5,297,728 | 3/1994 | Yano et al. | 62/225 |
| 5,303,864 | 4/1994 | Hirota | 236/92 B |
| 5,361,597 | 11/1994 | Hazime et al. | 62/205 |

FOREIGN PATENT DOCUMENTS

| | | | |
|---|---|---|---|
| 696 | 2/1898 | United Kingdom | 251/360 |

*Primary Examiner*—William E. Tapolcai
*Attorney, Agent, or Firm*—Foley & Lardner

[57] ABSTRACT

An expansion valve includes a valve body, a valve, a power element, and an aluminum heat sensing shaft. The heat sensing shaft has a hole with a bottom reaching a heat sensing portion thereof. The hole makes the heat transfer area of the heat sensing shaft small. Consequently, in a refrigeration system the response of the expansion valve is relatively insensitive to changes in a heat load of an evaporator. Thus, unwanted hunting phenomenon in the refrigeration system is prevented.

5 Claims, 4 Drawing Sheets

EXPANSION VALVE

TECHNICAL FIELD OF THE INVENTION

The present invention relates to expansion valves and, more particularly, to expansion valves used for refrigerant utilized in refrigeration cycles of air conditioners, refrigeration devices and the like.

BACKGROUND OF THE INVENTION

In the prior art, these kinds of expansion valves were used in refrigeration cycles of air conditioners in automobiles and the like. FIG. 5 shows a prior art expansion valve in cross section together with an explanatory view of the refrigeration cycle. The expansion valve 10 includes a valve body 30 formed of prismatic-shaped aluminum comprising a refrigerant duct 11 of the refrigeration cycle having a first path 32 and a second path 34, the one path placed above the other with a distance in between. The 15 first path 32 is for a liquid-phase refrigerant passing through a refrigerant exit of a condenser 5 through a receiver 6 to a refrigerant entrance of an evaporator 8. The second path 34 is for a liquid-phase refrigerant passing through the refrigerant exit of the evaporator 8 toward a refrigerant entrance of a compressor 4.

An orifice 32*a* for the adiabatic expansion of the liquid refrigerant supplied from the refrigerant exit of the receiver 6 is formed on the first path 32. The orifice 32*a* is positioned on the vertical center line taken along the longitudinal axis of the valve body 30. A valve seat is formed on the entrance of the orifice 32*a*, and a valve means 32*b* supported by a valve member 32*c*. The valve means 32*b* and the valve member 32*c* are welded and fixed together. The valve member 32*c* is fixed onto the valve means 32*b* and is also forced by a spring means 32*d*, for example, a compression coil spring.

The first path 32 where the liquid refrigerant from receiver 6 is introduced is a path of the liquid refrigerant, and is equipped with an entrance port 321 and a valve room 35 connected thereto. The valve room 35 is a room with a floor portion formed on the same axis as the center line of the orifice 32*a*, and is sealed by a plug 39.

Further, in order to supply drive force to the valve body 32*b* according to an exit temperature of the evaporator 8, a small hole 37 and a large hole 38 having a greater diameter than the hole 37 is formed on said center line axis perforating through the second path 34. A screw hole 361 for fixing a power element member 36 working as a heat sensor is formed on the upper end of the valve body 30.

The power element member 36 is comprised of a stainless steel diaphragm 36*a*, an upper cover 36*d* and a lower cover 36*h* each defining an upper pressure activate chamber 36*b* and a lower pressure activate chamber 36*c* forming two scaled chambers above and under the diaphragm 36*a*, and a tube 36*i* for enclosing a predetermined refrigerant working as a diaphragm driver liquid into said upper pressure activate chamber, wherein said lower pressure activate chamber 36*c* is connected to said second path 34 via a pressure hole 36*e* formed to have the same center as the center line axis of the orifice 32*a*. A refrigerant vapor from the evaporator 8 is flown through the second path 34. The second path 34 is a path for gas phase refrigerant, and the pressure of said refrigerant vapor is added to said lower pressure activate chamber 36*c* via the pressure hole 36*e*.

Further, inside the lower pressure activate chamber 36*c* is a valve member driving shaft comprising a heat sensing shaft 36*f* and an activating shaft 37*f* The heat sensing shaft 36*f* made of aluminum is movably positioned through the second path 34 inside the large hole 38 and contacting the diaphragm 36*a* so as to transmit the refrigerant exit temperature of the evaporator 8 to the lower pressure activate chamber 36*c*, and to provide driving force in response to the displacement of the diaphragm 36*a* according to the pressure difference between the upper pressure activate chamber 36*b* and the lower pressure activate chamber 36*c* by moving inside the large hole 38. The activating shaft 37*f* made of stainless steel is movably positioned inside the small hole 37 and provides pressure to the valve means 32*b* against the spring force of the spring means 32*d* according to the displacement of the heat sensing shaft 36*f* The heat sensing shaft 36*f* is equipped with a sealing member, for example, an O ring 36*g*, so as to provide seal between the first path 32 and the second path 34. The heat sensing shaft 36*f* and the activating shaft 37*f* are contacting one another, and the activating shaft 37*f* is in contact with the valve member 32*b*. Therefore, in the pressure hole 36*e*, a valve member driving shaft extending from the lower surface of the diaphragm 36*a* to the orifice 32*a* of the first path 32 is positioned having the same center axis as the pressure hole.

A known diaphragm driving liquid is filled inside the upper pressure activating chamber 36*b* placed above a pressure activate housing 36*d*, and the heat of the refrigerant vapor from the refrigerant exit of the evaporator 8 flowing through the second path 34 via the diaphragm 36*a* is transmitted to the diaphragm driving liquid.

The diaphragm driving liquid inside the upper pressure activate chamber 36*b* adds pressure to the upper surface of the diaphragm 36*a* by turning into gas in correspondence to said heat transmitted thereto. The diaphragm 36*a* is displaced in the upper and lower direction according to the difference between the pressure of the diaphragm driving gas added to the upper surface thereto and the pressure added to the lower surface thereto.

The displacement of the center portion of the diaphragm 36*a* to the upper and lower direction is transmitted to the valve member 32*b* via the valve member driving shaft and moves the valve member 32*b* close to or away from the valve seat of the orifice 32*a*. As a result, the refrigerant flow rate is controlled.

That is, the gas phase refrigerant temperature of the exit side of the evaporator 8 is transmitted to the upper pressure activate chamber 36*b*, and according to said temperature, the pressure inside the upper pressure activate chamber 36*b* changes, and the exit temperature of the evaporator 8 rises. When the heat load of the evaporator rises, the pressure inside the upper pressure activate chamber 36*b* rises, and accordingly, the heat sensing shaft 36*f* or valve member driving shaft is moved in the downward direction and pushes down the valve means 32*b* via the activating shaft 37, resulting in a wider opening of the orifice 32*a*. This increases the supply rate of the refrigerant to the evaporator, and lowers the temperature of the evaporator 8. In reverse, when the exit temperature of the evaporator 8 decreases and the heat load of the evaporator decreases, the valve means 32*b* is driven in the opposite direction, resulting in a smaller opening of the orifice 32*a*. The supply rate of the refrigerant to the evaporator decreases, and the temperature of the evaporator 8 rises.

In a refrigeration system using such expansion valve, a so-called hunting phenomenon wherein over supply and under supply of the refrigerant to the evaporator repeats in a short term is known. This happens when the expansion valve is influenced by the environment temperature, and, for example, the non-evaporated liquid refrigerant is adhered to the heat sensing shaft of the expansion valve. This is sensed as a temperature change, and the change of heat load of the evaporator occurs, resulting in an oversensitive valve movement.

When such hunting phenomenon occurs, it not only decreases the ability of the refrigeration system as a whole, but also affects the compressor by the return of liquid to said compressor.

The present applicant suggested an expansion valve shown in FIG. 6 as Japanese Patent Application No. H7-325357. This expansion valve 10 includes a resin 101 having low heat transfer rate being inserted to and contacting the heat sensing shaft 100 forming an aluminum valve member driving shaft. A PPS resin which will not be affected by the refrigerant and the like is used as the low heat transfer rate resin 101.

Said resin 101 is not only mounted on the portion of the heat sensing shaft 100 being exposed to the second path 34 where the gas phase refrigerant passes, but also on the heat sensing portion existing inside the lower pressure activate chamber 36*c*. The thickness of the resin 101 can be about 1 mm.

Further, it should be understood that the resin 101 could only be mounted on the exposed portion of the heat sensing shaft 100 to the second path 34.

By mounting such resin 101, when the non-evaporated refrigerant fiom the evaporator flows through the second path 34, and adheres to the heat sensing shaft of the expansion valve, the heat transfer rate of the resin 101 is low, so the change in heat load of the evaporator or increase of the heat load of the evaporator occurs, the response ability of the expansion valve 10 is low, and the hunting phenomenon of the refrigeration system is avoided.

The problem of the above-explained expansion valve is that it is expensive to produce such valve because there is a need to attach the resin 101 to the aluminum heat sensing shaft 100 in the manufacturing, process.

The object of the present invention is to provide a cost effective expansion valve which avoids the occurrence of hunting phenomenon in the refrigeration system with a simple change in structure.

SUMMARY OF THE INVENTION

In order to solve the problem, the first embodiment of the expansion valve of the present invention comprises a valve body having a first path for the liquid refrigerant to pass, and a second path for the gas refrigerant to pass from the evaporator to the compressor, an orifice mounted in the passage of said liquid refrigerant, a valve means for controlling the amount of refrigerant passing through said orifice, a power element portion mounted on the valve body having a diaphragm operating by the pressure difference between the upper and lower portion of the valve body, and a heat sensing shaft contacting said diaphragm at one end for driving the valve means by the displacement of the diaphragm and driving said valve means at the other end, wherein said heat sensing shaft includes a structure for making the heat transfer area small.

The second embodiment of the present invention is characterized in that said structure for making the heat transfer area small is a hole with a bottom formed of a portion of the heat sensing shaft contacting the diaphragm.

The third embodiment of the present invention is characterized in that said hole with a bottom is formed from said portion of the heat sensing shaft contacting the diaphragm reaching to the exposure portion inside the second path.

The fourth embodiment of the present invention is characterized in that a thin width portion is formed on the heat sensing shaft for making the heat transfer area small.

Further, the fifth embodiment of the present invention is characterized in that said thin width portion is formed from said portion of the heat sensing shaft contacting the diaphragm reaching to the exposure portion inside the second portion.

The sixth embodiment of the present invention is characterized in that a concave portion is mounted on the surface of said heat sensing shaft contacting said diaphragm.

The expansion valve having said structure is free from said oversensitive valve open/close response even through a change in temperature often resulting in a hunting phenomenon of a refrigeration system, because the heat transfer speed of said heat sensing shaft of the valve means driving shaft is made to be slow,

DETAILED DESCRIPTION

The embodiment of the present invention according to the drawings will be explained below.

Figure 1:
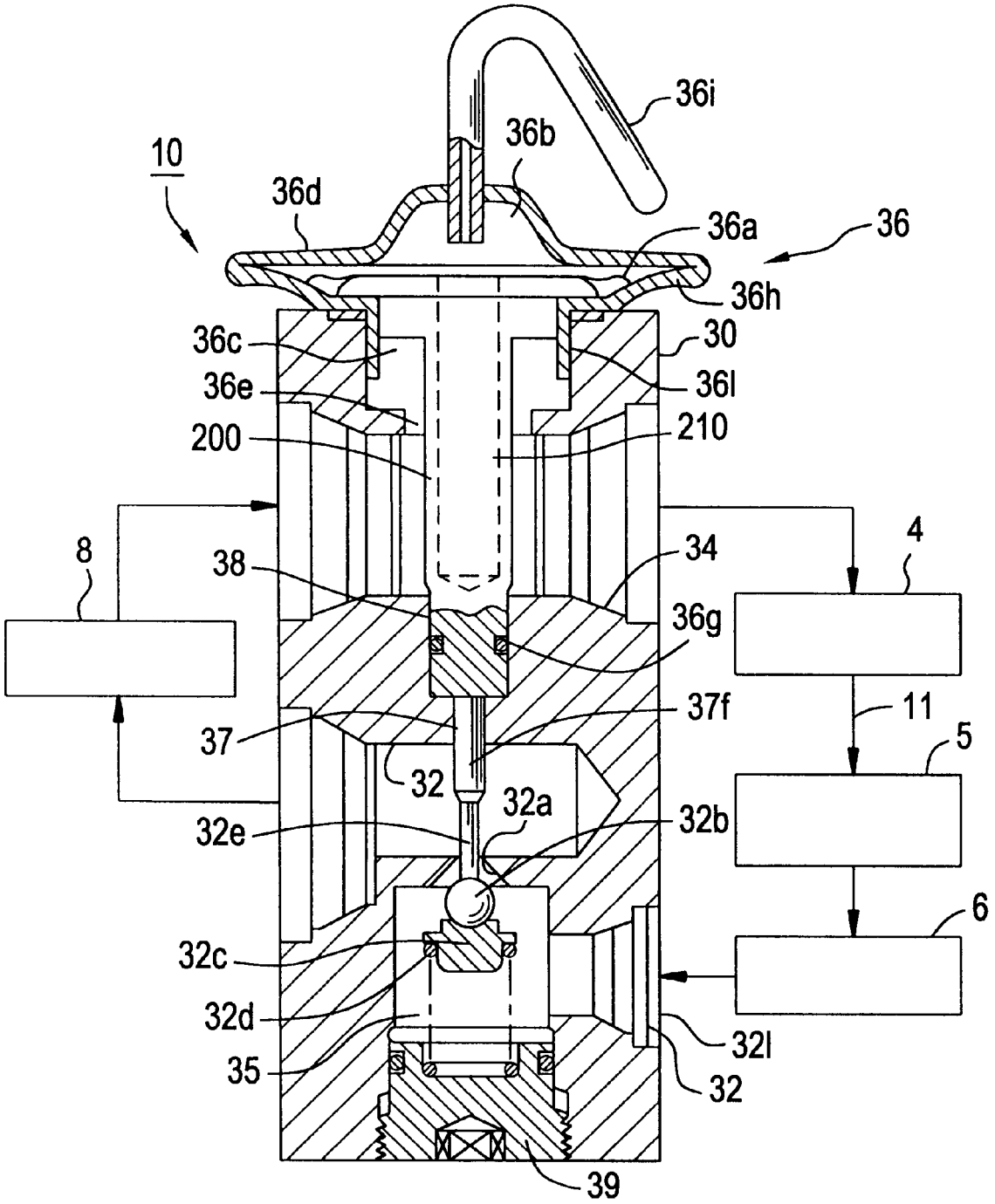
FIG. 1 shows a vertical cross-sectional view of the expansion valve according to one embodiment of the present invention.
Figure 5:
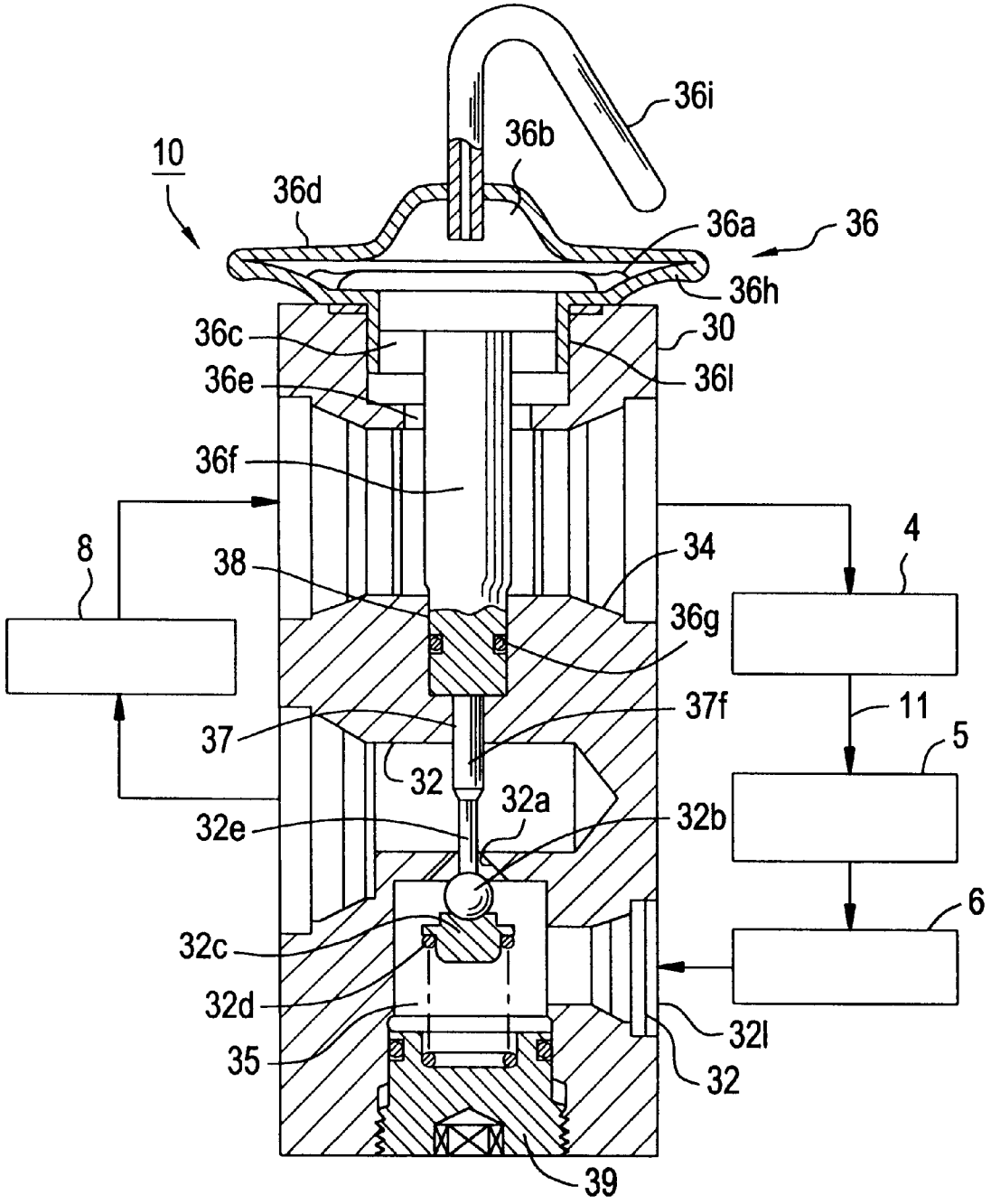
FIG. 5 is an explanatory view of the refrigeration cycle and the vertical crosssectional view of the expansion valve of the prior art.
Figure 6:
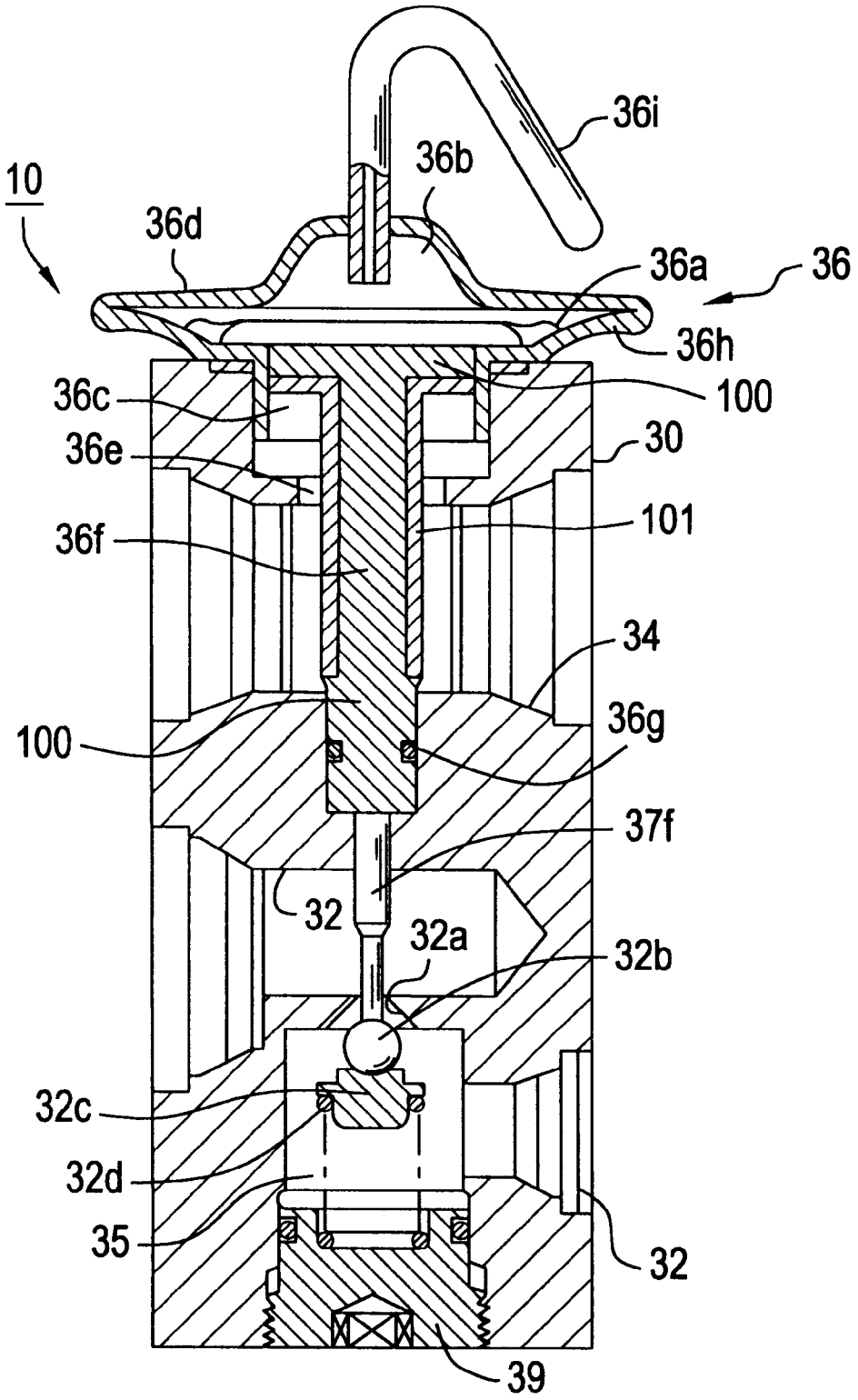
FIG. 6 is a vertical cross-sectional view of the expansion valve suggested by the present applicant.

FIG. 1 shows the expansion valve 10 for controlling the refrigerant supply amount in a vertical cross-sectional view, and the same reference numbers as FIG. 5 show the same or equivalent portions.

Figure 2:
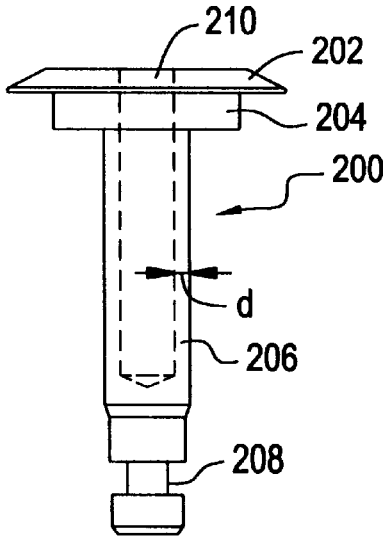
FIG. 2 is a front view of the heat sensing shaft showing the main portion of one embodiment of the present invention.

FIG. 2 is a front view of the heat sensing shaft 200 of FIG. 1.

The expansion valve 10 comprises an aluminum body 30, and the aluminum body 30 is equipped with a first path 32 for liquid-phase refrigerant and a second path 34 for gas-phase refrigerant as was explained in reference with FIG. 5. A valve means 32*b* mounted on a valve room 35 is connected to a heat sensing shaft 200 via an activating shaft 37.

The heat sensing shaft 200 is a cylindrical member made of aluminum, and comprises a receive member 202 of a diaphragm 36*a*, a large diameter portion 204 for being inserted moveably to a lower coveI 36*h* of a power element portion 36, a heat sensing portion 206 being exposed inside the second path 34, and a groove 208 for supporting a seal member.

As shown in detail in FIG. 2, a hole 210 having a bottom is formed in the center of the heat sensing shaft 200 as a structure for makting the heat transfer area small. This hole 210 is formed by a preferred method, for example, a digging process by a drill and the like.

Further, in the embodiment shown in FIG. 2, the hole with a bottom formed on the heat sensing shaft is formed from the portion contacting the diaphragm of the heat sensing shaft reaching the exposure portion inside the second path. However, it should be noticed that the depth of the hole with a bottom could be changed by design choice.

Therefore, by the present invention, the hole 210 with a bottom is formed on the heat sensing shaft 200, so in other words, the heat sensing shaft 200 is equipped with a thin width portion, and the thickness of the thin width portion is, for example, about 1 mm.

Further, in the heat sensing shaft of FIG. 1 and FIG. 2, the diameter of the heat sensing portion is 6.6 mm, the diameter of the hole 210 is 4.6 mm, the depth of the hole 210 is 25 mm.

By the present invention, the temperature of the gas-phase refrigerant flowing through the second path 34 is transmitted to the heat sensing portion 206 of the heat sensing shaft 200, and to the gas inside the upper pressure activate chamber of the diaphragm.

At this stage, when the speed of transfer of the heat from the heat sensing, portion 206 to the upper pressure activate chamber 36*b* is too fast, it would cause unwanted hunting phenomenon.

The heat sensing shaft 200 of the present invention includes a hole formed from the diaphragm receiving portion reaching to the exposure portion in the second path, and having a thin wall width.

By such structure, the heat sensing shaft of the present invention, even though it is made of aluminum which has a high heat-transfer character, has decreased heat transfer area, and the heat is slowly transferred to the diaphragm portion is slow.

An unwanted hunting phenomenon could be prevented from occurring.

Figure 3:
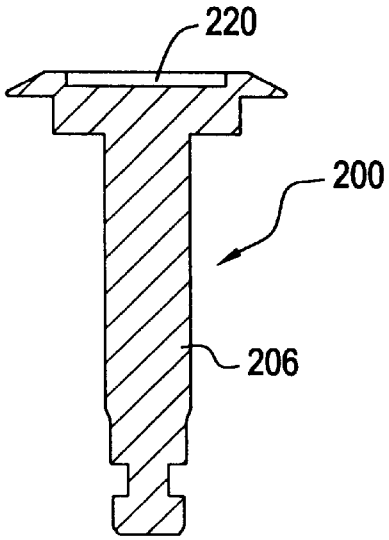
FIG. 3 is a vertical cross-sectional view of the heat sensing shaft showing the main portion of another embodiment of the present invention.

Other than the above-mentioned embodimnent, the heat transfer area could also be made small by forming a concave to the heat sensing shaft. FIG. 3 shows such embodiment. In the drawing, a concavity of concave portion 220 is formed on the heat sensing shaft 200 on the center portion of the surface of the power element portion contacting the diaphragm. By such concave portion, the center portion of the diaphragm will not contact the upper surface of the heat sensing shaft. The depth and the size of the concave portion 220 is a design choice.

According to this embodiment, the temperature of the gas-phase refrigerant flowing through the second path 34 will be transmitted to the heat sensing portion 206 of the heat sensing shaft 200, and then transmitted to the gas inside the upper pressure activate chamber 356. However, the heat transfer area of the heat sensing shaft 200 is made small by the concave portion 220, so the transfer speed of the heat is slowed, and thus hunting phenomenon is prevented.

Figure 4:
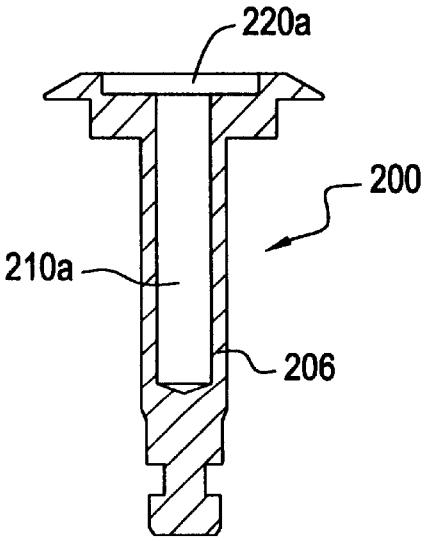
FIG. 4 is a vertical cross-sectional view of the heat sensing shaft showing the main portion of yet another embodiment of the present invention.

Further, FIG. 4 shows another embodiment of the present invention wherein the heat sensing shaft comprises the concave portion 220 shown in FIG. 3 and the hole 210 shown in FIG. 2. In this embodiment, the heat transfer area could also be made small. Further, in FIG. 4, reference 220*a* shows the concave portion, and reference 210*a* is the hole.

The hole with a bottom of the heat sensing shaft in this embodiment is shown to reach the second path. However, the depth of the hole could be changed to a preferred size, and for example, the depth could be decreased to make the heat transfer area small, and the size of the concave portion could also be changed to a preferred size.

As could be understood from the above explanation, the expansion valve of the present invention prevents unwanted sensitive valve opening/closing response tile valve, and thus prevents a hunting phenomenon occurring in tile refrigeration cycle.

We claim:

1. An expansion valve comprising:

a valve body having a first path for guiding a liquid-phase refrigerant and a second path for guiding a gas-phase refrigerant between an evaporator and a compressor, wherein the first path includes an orifice;

a valve that controls the amount of refrigerant passing through said orifice;

a power element portion formed on said valve body and having a diaphragm that is displaced due to a difference between pressures applied on the diaphragm by first and second chambers; and a heat sensing shaft for driving said valve, an end of the heat sensing shaft contacting said diaphragm and another end of the heat sensing shaft driving said valve based on displacement of said diaphragm, wherein said heat sensing shaft has a void formed therein and the void is separated from the first and second chambers.

2. The expansion valve of claim 1, wherein the void includes a hole extending into the heat sensing shaft from the end contacting the diaphragm.

3. The expansion valve of claim 2, wherein the hole extends at least to a portion of the heat sensing shaft exposed to the second path.

4. The expansion valve of claim 1, wherein the void includes a concave portion formed on a surface of the end of the heat sensing shaft that contacts the diaphragm, and a width of the concave portion along the surface is greater than a depth of the concave portion along a longitudinal axis of the heat sensing shaft.

5. An expansion valve according to claim 1, wherein the diaphragm separates the void from the first and second chambers.

* * * * *